US006269563B1

(12) United States Patent
Dagan

(10) Patent No.: US 6,269,563 B1
(45) Date of Patent: Aug. 7, 2001

(54) PERPETUAL CALENDAR

(76) Inventor: Gideon Dagan, 986 Vernon Ave., Venice, CA (US) 90291

( * ) Notice: Subject to any disclaimer, the term of this patent is extended or adjusted under 35 U.S.C. 154(b) by 0 days.

(21) Appl. No.: 09/325,586

(22) Filed: Jun. 3, 1999

(51) Int. Cl.[7] ..... G09D 3/00

(52) U.S. Cl. ..... 40/107; 40/110; 40/426; 446/129; 446/133

(58) Field of Search ..... 40/107, 110, 426, 40/600, 621; 283/2; 446/129, 133, 134, 137

(56) References Cited

U.S. PATENT DOCUMENTS

| | | | | |
|---|---|---|---|---|
| 774,325 | * | 11/1904 | Illing | 40/110 |
| 3,235,260 | * | 2/1966 | Glass et al. | 273/141 A |
| 3,307,850 | * | 3/1967 | Thomas | 273/161 |
| 3,707,290 | * | 12/1972 | Birnkrant | 273/141 A |
| 4,178,707 | * | 12/1979 | Littlefield | 40/426 |
| 4,211,414 | * | 7/1980 | Moodt | 273/141 A |
| 4,308,678 | * | 1/1982 | Slobin | 40/113 |
| 4,723,232 | * | 2/1988 | Beebe | 368/76 |
| 5,058,296 | * | 10/1991 | Notzel | 40/107 |
| 5,060,947 | * | 10/1991 | Hall | 273/138.2 |

FOREIGN PATENT DOCUMENTS

| | | | | |
|---|---|---|---|---|
| 602604 | * | 5/1948 | (GB) | 40/107 |

* cited by examiner

*Primary Examiner*—Anthony Knight
*Assistant Examiner*—Andrea Chop
(74) *Attorney, Agent, or Firm*—Natan Epstein; Beehler & Pavitt

(57) ABSTRACT

A perpetual calendar has a free standing or wall hung structure supporting an anchor point and a number of concealed magnets. A pointer magnet is attached by a line to the anchor point. Attraction between the pointer magnet and a selected one of the concealed magnets can support the pointer magnet and line in levitation against gravitational pull. The concealed magnets may be arranged in an arc on the calendar structure, with day, month or year data indicated along the arc at locations corresponding to the concealed magnet locations, so that the line and pointer magnet serve as a visual indicator of selected calendar data. Multiple displays of calendar data may be provided on a calendar structure, including multiple levitated pointer displays or combinations of levitated displays and sliding pointer displays.

23 Claims, 3 Drawing Sheets

PERPETUAL CALENDAR

BACKGROUND OF THE INVENTION

1. Field of the Invention

This invention pertains to the field of perpetual calendars and more particularly concerns a free standing or wall hung permanent calendar structure incorporating concealed permanent magnets supporting a string pointer.

2. State of the Prior Art

Perpetual calendars are devices which require periodic adjustment to display a combination of data which together make up a calendar date. For example, a perpetual calendar may show day-of-week, day-of-month and month-of-year data. The perpetual calendar is equipped with an indicator device which permits the user to select or point to a particular combination of day-of-week datum, day-of-month datum and month-of-year datum and thereby display a calendar date. This display must be updated periodically by the user.

Perpetual calendars have been known since antiquity and innumerable arrangements have been devised, limited only by human ingenuity and imagination and ranging from mundane utilitarian objects to inspired works of art. Creativity in this field is far from exhausted and a continuing demand exists for intriguing new designs.

SUMMARY OF THE INVENTION

The present invention is a perpetual calendar includes one or more calendar data displays, each display covering a subset of calendar data such as day-of-week, day-of-month, month-of-year and year. The one or more displays are arranged on a calendar structure which may be free standing or wall hung.

Two types of calendar data displays may be combined in the perpetual calendar of this invention: a levitated display featuring a magnetically levitated pointer and a bar display with a sliding indicator.

The levitated display includes a first number of datum locations and an anchor point on the calendar structure. At each datum location is indicated, as by printed lettering or numerals, one datum of the calendar data subset. A fixed magnetic attractor is located at each of the datum locations and a movable magnetic attractor is secured to a free end of a flexible cord, such as a plastic or nylon line or a string. The opposite end of the cord is attached to the anchor point. The length of the cord is such that it is held taut with the movable attractor suspended near a datum location on the calendar structure because of magnetic attraction between a fixed attractor and the movable attractor. The suspended movable attractor and the taut cord serve as an indicator or pointer towards a selected datum location. This pointer can be easily repositioned from one to another datum location just by pushing the movable magnetic attractor away from the attractive force of one fixed attractor and into the force field of another fixed attractor. The fixed and movable attractors may be a pair of small permanent magnets, or a permanent magnet paired with a ferromagnetic metal element such as a steel or iron element. Electromagnets may be substituted for permanent magnets, and the electromagnets may be electronically controlled for automatic calendar opertation.

For aesthetic appearance the fixed attractors may be concealed in the calendar structure. Likewise, the moving attractor may be concealed inside an indicator body of appealing exterior form, for example, a sphere or other regular geometric body.

It is preferable that the fixed attractors be arranged in an arc centered about the anchor point, so that the anchor point is equidistant to all of the datum locations and the moving attractor remains equally spaced to each datum location as it is moved from one datum to another. For example, the calendar structure may include an arc portion with the datum locations spaced along the arc.

A useful perpetual calendar should display at least two data elements, such as day-of-month and month-of-year. For this reason the calendar structure may include more than one calendar data display, at least one of which is a levitated indicator, each display covering a different subset of calendar data.

In one calendar configuration, two different data subsets can be arranged along separate arc portions each with a magnetically levitated pointer. For example, the separate arc portions may be two arc segments spaced apart on a closed ring structure, or two concentric half-circles of different diameters on a common base.

The bar display may include a straight or curved bar with a subset of data presented at datum locations spaced along a slide surface of the bar display. The bar display also has paired magnetic attractors including one or more fixed magnetic attractors along the slide surface and a movable magnetic attractor continuously displaceable along the slide surface. The fixed attractor may be either a continuous magnetic strip so that the movable attractor is retained magnetically while sliding against the slide surface, or may consist of discrete magnetic attractors positioned at each of the datum locations along the slide surface so as to attract the movable magnetic attractor to each datum location. In either case the movable magnetic attractor is positionable at any one of the datum locations along the slide surface as a visual pointer to a second calendar datum on the bar display. The bar and the slide surface may be a straight bar or a curved bar of arbitrary curvature, such as a sinusoidal wave.

Attractive calendar structures can be devised by combining a levitated display intersected by a bar display in various configurations and arrangements.

DETAILED DESCRIPTION OF THE PREFERRED EMBODIMENTS

Figure 1:
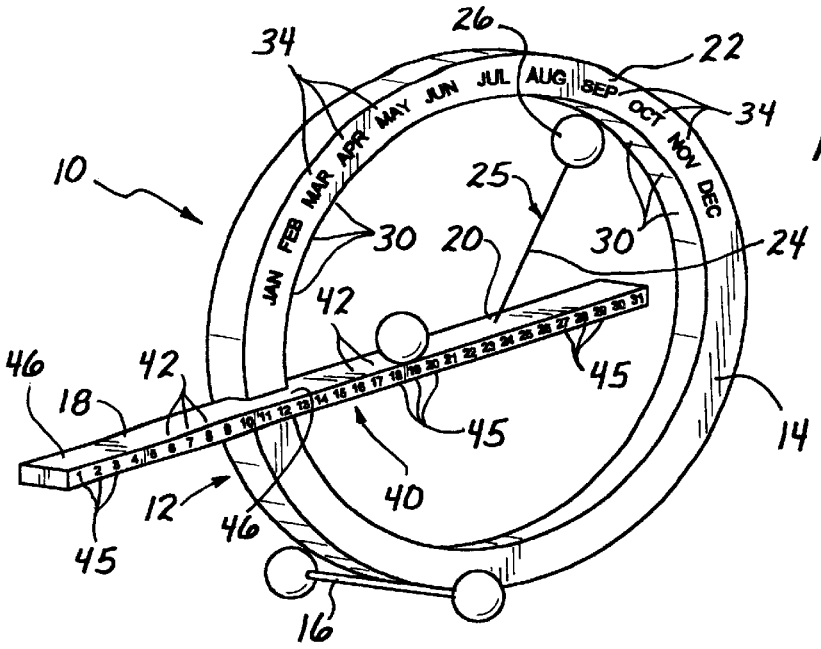
FIG. 1 is a perspective view of a typical perpetual calendar according to this invention, combining one levitated display and one bar display.

With reference to the accompanying drawings wherein like elements are designated by like numerals, FIG. 1 shows a perpetual calendar according to this invention generally designated by numeral 10. Calendar 10 has a calendar structure 12 which includes a continuous ring 14 supported in upright position on a base 16 which may be a removable base. A straight horizontal bar 18 intersects the ring 14 and is cantilevered at the 9 o'clock position of the ring, such that part of the bar length lies along a diameter line within the ring and another part of the bar extends radially outwardly of the ring.

The bar 18 provides an anchor point 20 which is near or at the center of the ring 14. A levitated display of calendar 10 includes an arc portion 22 extending about 140 degrees of arc along the top of ring 14, and a levitated indicator comprised of a cord line 24 secured at its lower end to anchor point 20 and an indicator body 26 attached to the free end of the cord line 24. The cord line is readily flexible or pliable, that is, is not self-supporting in any particular shape, and can be made of any esthetically appealing material such as a length of nylon or other synthetic line, or of natural fiber string material. The indicator body 26 is a spherical geometric body which contains a concealed magnetic attractor 28, seen in FIG. 2. A number of datum locations 30 are evenly spaced along the arc portion 22, each datum location being specified by a concealed fixed magnetic attractor 32. The number of datum locations 30 depends on the particular calendar information to be indicated by the levitated display. If month-of-year information is to be shown twelve datum locations are provided, one for each month of the year. If day-of week data is to be displayed, seven datum locations 30 are required, one for each day of the week. Appropriate calendar data are indicated at each of the datum locations 30, as by permanently applied lettering or other indicia 34 which provide a visual indication of each datum, e.g. the name of each month of the year.

The length of cord line 24 is such as to allow the movable magnetic attactor in indicator body 26 into sufficient proximity to any of the fixed attractors 32 so that magnetic attraction between the movable and fixed attractors supports the indicator in a seemingly gravity defying levitated state, suspended in midair in close proximity to but short of contact with the ring 14. The magnetic attraction also holds the cord line 24 stretched taut in a straight line between anchor point 20 and indicator 26. For example, a $1/32^{nd}$ inch (0.5 mm) thick black cord line 24 and a $5/8^{th}$ inch diameter indicator sphere 26 have been found suitable for an 8¼ inch diameter calendar ring 14. The cord line 24 does not have to be black, however, or even visible. The taut cord line in combination with the indicator body 26 provides a levitated indicator or pointer 25 which uniquely designates and directs the viewer's eye to one of the datum location 30. The designated datum position is manually selected by the calendar user by bringing the indicator body into sufficient proximity to the desired datum location until magnetic attraction holds the indicator body in position at that datum location. This process is facilitated by spacing the datum positions along the arc so that the indicator body can be readily swung from one datum position to the next without losing levitation. In practice, when lightly pushed to one side or the other along the arc 22 the pointer 25 can be made to snap into position from one datum location to the next in a sensually gratifying manner. The central or near central position of the anchor point 20 is approximately equidistant to each datum location 30 so that indicator body 26 is also at an approximately equal distance from the ring 14 at each datum location, making for a pleasing symmetry of the display at all positions of the pointer 25.

The magnetic attractors may be small permanent magnets oriented with opposite magnetic poles of fixed and movable attractor pairs facing each other, so that the magnets attract rather than repel each other. Alternatively, a permanent magnet may be paired with a ferromagnetic element, such as a steel or iron element, in which case magnetic polarity is not an issue. However, pairing two permanent magnets allows use of physically smaller attractors due to the mutually attractive force between them, while pairing one magnet with a steel element, for example, calls for a stronger and possibly physically larger magnet, as well as a larger steel element to achieve an equivalent attractive force. This problem may be circumvented, partly or entirely, by use of more exotic magnetic materials. It may be convenient to use cylindrically shaped magnetic attractors, both as fixed and movable attractors, because these can be fitted into and concealed in holes drilled in a solid ring 14 and solid indicator body 26, respectively. These holes can then be filled with suitable filler material or plugs to conceal the holes themselves for good appearance and to enhance the apparent mystery of attraction between the ring and indicator body. It is also contemplated that electromagnets may be used as the magnetic attractors 28, 32, in which case a suitable supply of electrical power is provided. Use of electromagnets makes possible the electronic control of the perpetual calendar, as by a suitably programmed microprocessor driven by an electronic clock, so that the appropriate fixed attractor 32 is automatically powered, causing the pointer 25 to move to the newly powered attractor without need for manual adjustment.

The ring 14 and bar 18 can be made of solid material such as wood or any other material, suitably drilled for insertion of the magnetic attractors, or can be assembled from injection molded parts with the magnetic attractors inserted between the parts prior to assembly of the ring and bar. The calendar structure may be made of any material provided it does not prevent magnetic attraction of the fixed and movable attractors.

Figure 2:
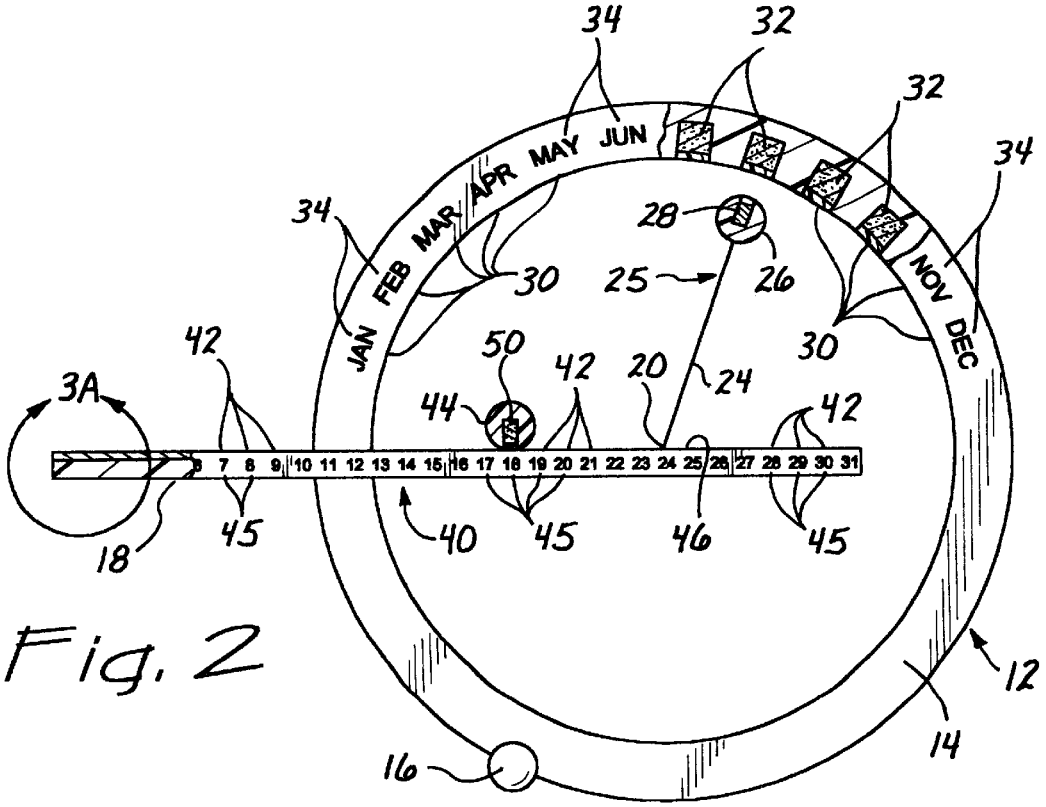
FIG. 2 is a front view of the perpetual calendar of FIG. 1 showing the magnetic attractors in both the levitated and bar displays.
Figure 3A:
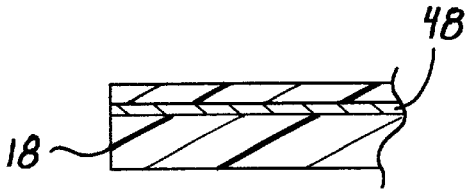
FIG. 3*a* is fragmentary vertical sectional view of the bar display in FIG. 2 showing a continuous fixed magnetic attractor on the bar.

The permanent calendar 10 of FIGS. 1 and 2 also includes a bar display 40 which serves to display and indicate a second set of calendar data complementary to the calendar data indicated by the levitated display described above. The bar display 40 includes the bar 18 along which are evenly spaced datum locations 42. A calendar datum such as a numeral ranging from 1 through 31, indicative of the day-of-the-month, is applied as by printed indicia 45 at each datum location. A moving indicator body 44, which may be a geometric body selected for esthetic appeal is displaceable along the bar 18 to any of the datum locations. The width of bar 18 is such as to provide a continuous slide surface 46 uninterrupted by ring 14 at the intersection point to allow continuous sliding movement of the bar indicator body 44. It is preferable to secure the bar indicator body 44 to the bar against accidental displacement from a selected datum location and also against accidental loss. A presently preferred manner of securing the indicator body 44 is by means of magnetic attractors. A fixed magnetic attractor in the form of continuous strip 48, which may be of rubber-metal magnetic composite sheet material, is concealed in the bar 18, as suggested in FIG. 3A. A magnetic attractor, either a permanent magnet or a ferromagnetic metal element 50, is concealed in the bar indicator body 44, in suitable polar orientation to establish magnetically retentive force between the indicator body 44 and magnetic strip 48 in display bar 18. The indicator body can be positioned at a selected datum location 42, to indicate a particular calendar datum 45 such as a given day-of-the-month, without breaking magnetically retentive attraction while sliding the indicator along the slide surface 46. This attractor arrangement provides substantially continuous magnetic attraction along the length of the bar indicator 40, and the user is called upon to position the indicator body 44 in correct relationship to the selected datum location 42. The slide surface 46 is shown as a top surface of the bar, but it may also be a bottom surface on the underside of the bar so that the movable indicator 44 is retained against gravity by magnetic attraction to the fixed magnetic attractor 48.

Figure 3B:
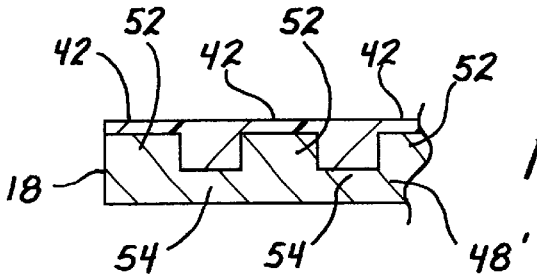
FIG. 3*b* is a fragmentary horizontal sectional view of the bar display in FIG. 2 showing an alternate fixed magnetic attractor with attraction sites corresponding to respective datum locations along the bar.

FIG. 3B shows an alternate fixed magnetic attractor 48' which assists in positioning the movable indicator body 44 at discrete positions corresponding to the datum locations 42 along the slide surface 46 of display bar 18. This is accomplished by cutting a continuous magnetized strip so as to define wide attractor areas 52 connected by narrower link areas 54. Because of its varying width the fixed attractor strip the magnetic attraction exerted on the movable attractor in indicator body 44 also varies along the bar and is strongest at the wide attractor areas 52. By aligning these areas 52 with corresponding datum locations 42 the user is assisted in aligning the indicator body with the calendar indicia displayed at each datum location, while still maintaining a lesser magnetic retentive force at intermediate positions between datum locations to avoid separation of the indicator body 44 from the bar 18 during sliding displacement. It is also within the scope of this invention to provide entirely separate fixed magnetic attractors at each datum location along the slide surface of the display bar 18, although this becomes inconvenient where thirty-one day-of-month locations are needed.

Figure 4:
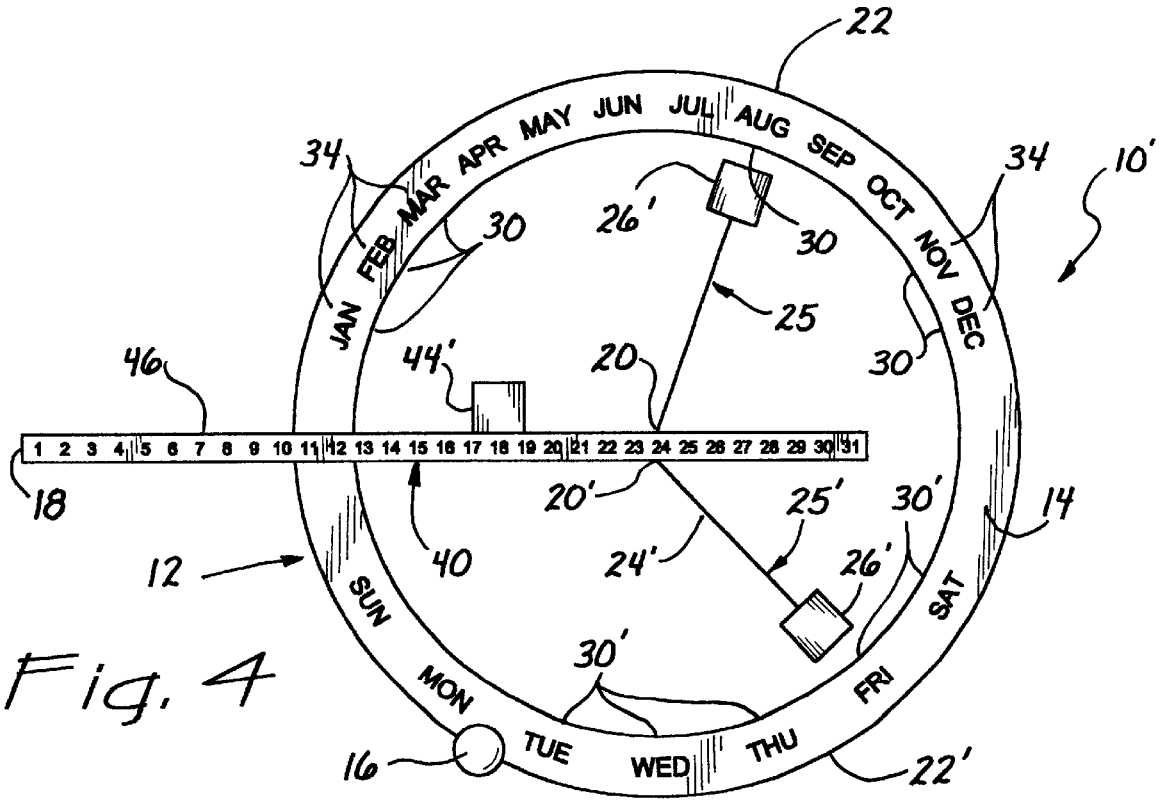
FIG. 4 is a front view of an alternate perpetual calendar similar to the calendar of FIG. 1 but having upper and lower levitated displays in addition to a bar display.

FIG. 4 depicts an alternate perpetual calendar 10' which is structurally similar to calendar 10 of FIGS. 1 and 2, except that first and second levitated displays have been provided on diametrically opposed arc portions of ring 14. Cubic indicator bodies 26' have been substituted for the spherical indicator body 26 of FIGS. 1 and 2. An upper levitated display is analogous to the single levitated display in FIGS. 1 and 2. The second levitated display includes an arc portion 22' along the bottom of the ring 14, with a number of fixed magnetic attractors arranged at a number of datum locations 30' appropriate to the calendar information to be displayed. A second levitated indicator 25', which includes cord line 24' and indicator body 26', is secured to a second anchor point 20' on the bar 14. The upper and lower anchor points 20, 20' may be respectively on the top and bottom surfaces of the bar with the ring center located between the anchor points, so that the two anchor points are both close to the ring center and respectively nearly equidistant to the datum locations of the respective arc portions 22, 22'.

In calendar 10' the upper levitated display 25 may show month-of-year information, the bar display 40 may provide day-of-month information, while the bottom levitated display 25' can show day-of-week information. It should be appreciated, however, that the various displays may show any desired combination of calendar data in any arrangement believed to be convenient and appealing, and this invention is not limited to any combination or arrangement of calendar data on the calendar structure 12.

A physically arcuate structure is most convenient for carrying the fixed magnetic attractor array of the levitated display along an arc portion. However the fixed attractors of the levitated display structure may be arranged in an arc pattern on any supporting structure whether arc shaped or not. It suffices that the fixed attractors be approximately equidistant to the movable indicator body at all datum locations of the display.

Figure 5:
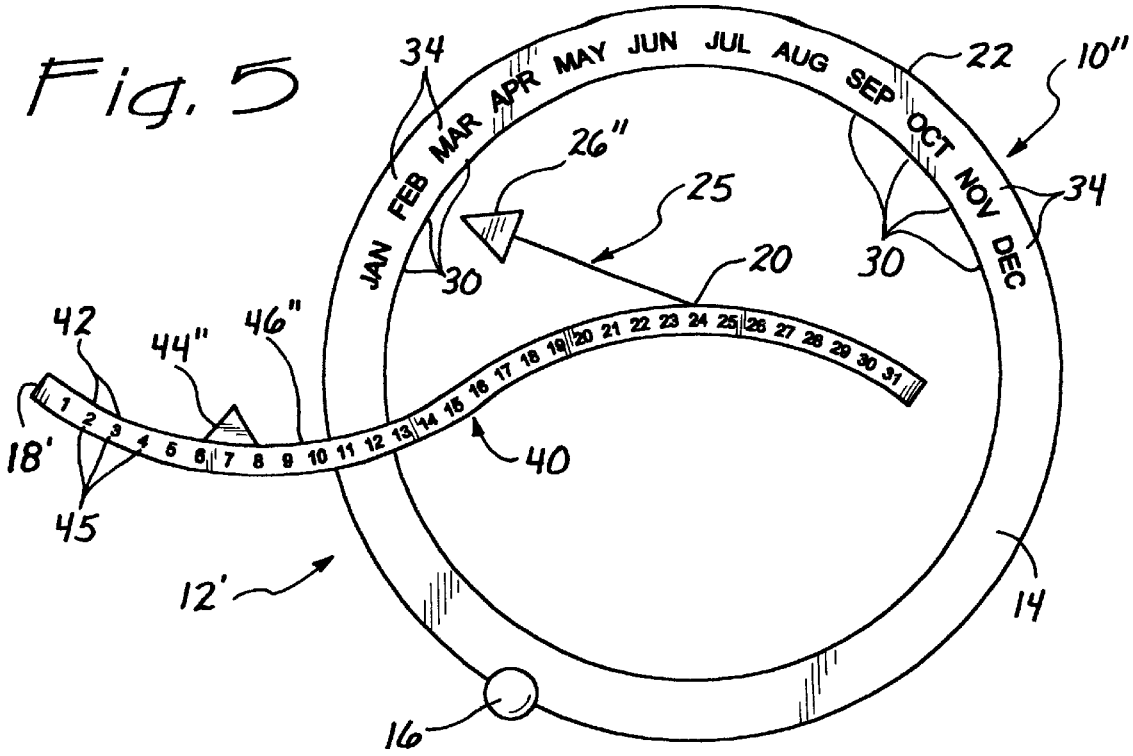
FIG. 5 is a front view of a perpetual calendar similar to the calendar of FIG. 1 wherein the straight bar display has been replaced by a wave shaped display.

FIG. 5 depicts a perpetual calendar 10" which is similar to the calendar 10 of FIG. 1, except that the straight bar display of FIG. 1 has been replaced by a generally sinusoidally wave shaped bar 18' with a similarly wave shaped slide surface 46", and the spherical indicator bodies 26, 44 have been replaced by pyramidal shaped indicator bodies 26", 44".

Figure 6:
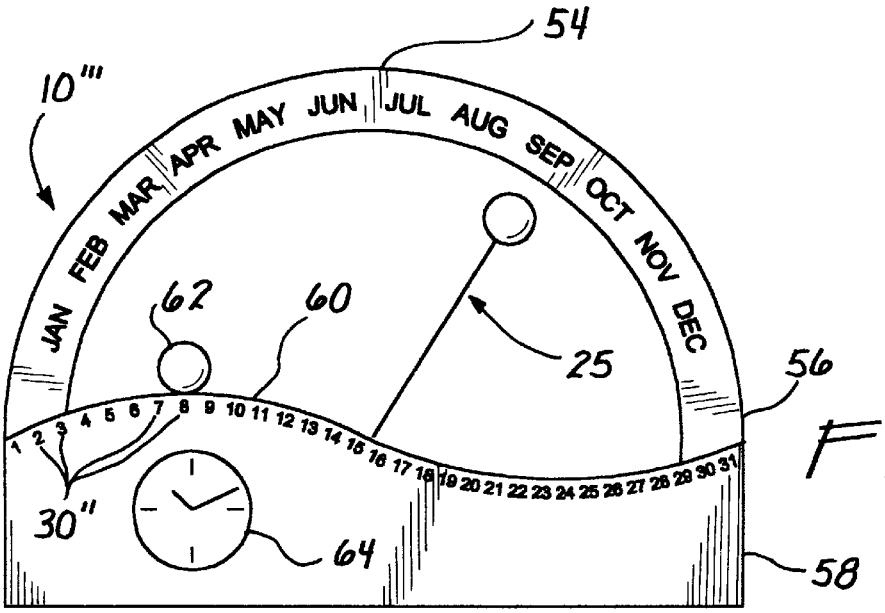
FIG. 6 is a front view of another perpetual calendar having a levitated display and a sinusoidally curved bar display on a calendar base.

FIG. 6 illustrates a perpetual calendar 10'" according to this invention featuring a levitated display 25 including arc portion 54 on a generally semi-circular bow structure 56 mounted on a base 58 which has a wave shaped bar display slide surface 60. An indicator body 62 is displaceable along the slide surface 60 as a pointer to any one of multiple datum locations 30" along the base 58. A fixed magnetic attractor arrangement is provided along the slide surface 60 which cooperates with a movable attractor concealed in indicator body 62, together providing a bar display analogous in function and operation to the bar display 40 described in connection with FIGS. 1, 2, 3A and 3B. Optionally, a clock 64 can be mounted on the base 58 to complement the calendar display with a time display.

While several embodiments of the perpetual calendar of this invention have been described and illustrated for purposes of clarity and example, it should be understood that still other changes, substitutions and modifications will be apparent to those having no more than ordinary skill in the art without thereby departing from the scope of this invention which is defined by the following claims.

What is claimed as new is:

1. A perpetual calendar for indicating date information selected from the group consisting of day-of-week, day-of-month and month, said perpetual calendar comprising:

a structure having a bottom and providing an anchor point on said structure above said bottom and a first plurality of spaced apart datum locations located above said bottom and said anchor point, a first plurality of first magnetic attractors stationary on said structure and each corresponding to only one of said datum locations, first date indicia at each of said datum locations, a second magnetic attractor anchored by a line to said anchor point, said line being shorter than a distance between any of said datum locations and said anchor point but sufficiently long so that said second magnetic attractor is held in static suspension above said anchor point by magnetic attraction if brought into sufficient proximity under any selected one of said first magnetic attractors among said first plurality of magnetic attractors and said line is held taut by said magnetic attraction, so that said line and said second magnetic attractor remain as a visual pointer to said first date indicia at a selected one of said datum locations until displaced from attraction to the selected one of said first magnetic attractors and into sufficient proximity to another one of said first magnetic attractors among said first plurality.

2. The perpetual calendar of claim 1 wherein said second magnetic attractor is in the form of a geometric body.

3. The perpetual calendar of claim 1 wherein each said first magnetic attractor is contained within said structure.

4. The perpetual calendar of claim 1 wherein said datum locations are spaced along an arc on said structure.

5. The perpetual calendar of claim 1 wherein said anchor point is approximately equidistant to any of said datum locations.

6. The perpetual calendar of claim 1 wherein said datum locations are substantially contained in a common plane with said anchor point.

7. The perpetual calendar of claim 1 wherein at least one of said first magnetic attractors and said second magnetic attractor is a permanent magnet.

8. The perpetual calendar of claim 1 further comprising a slide surface defined on said structure, a second plurality of datum locations spaced along said slide surface, second date indicia at said second plurality of datum locations, a third magnetic attractor along said slide surface, and a fourth magnetic attractor continuously displaceable along said slide surface in magnetically retentive relationship with said third magnetic attractor, such that said fourth magnetic attractor is positionable at any of said second plurality of datum locations as a visual pointer to said second date indicia at a selected one of said second plurality of datum locations.

9. The perpetual calendar of claim 8 wherein said slide surface is generally linear.

10. The perpetual calendar of claim 8 wherein said slide surface is substantially in a straight line.

11. The perpetual calendar of claim 8 wherein said slide surface is in a wavy line.

12. The perpetual calendar of claim 8 wherein said third magnetic attractor is substantially continuous along said slide surface such that said fourth magnetic attractor is continuously positionable along said slide surface in said magnetically retentive relationship.

13. The perpetual calendar of claim 8 wherein said third magnetic attractor is configured such that said fourth magnetic attractor is positionable in said magnetically retentive relationship at discrete locations along said slide surface corresponding to said second plurality of datum locations.

14. The perpetual calendar of claim 8 wherein said structure comprises an arcuate portion including said first plurality of spaced apart datum locations and said slide surface intersects said arcuate portion.

15. A perpetual calendar comprising:

a base, a structure supported on said base and including an arcuate portion, and an anchor point above said base and below said arcuate portion, a first plurality of datum locations spaced along said arcuate portion, a plurality of first magnetic attractors stationary on said structure including a first magnetic attractor at each of said datum locations, first date indicia at each of said datum locations, a second magnetic attractor anchored by a line to said anchor point, said line having a length sufficient to bring said second magnetic attractor within magnetic attraction range of any one of said first magnetic attractors so as to hold said second magnetic attractor in levitation above said anchor point against the force of gravity in proximity to any one of said first magnetic attractors with said line held taut above said anchor point by said magnetic attraction thereby to serve with said second magnetic attractor as a visual pointer to said first date indicia at a selected one of said first plurality of datum locations, said second magnetic attractor remaining stationary until displaced into proximity to another first magnetic attractor in said plurality of first magnetic attractors.

16. The perpetual calendar of claim 15 further comprising a generally linear slide surface supported on said structure, a second plurality of datum locations spaced along said slide surface, second date indicia at said second plurality of datum locations, a third magnetic attractor along said slide surface, and a fourth magnetic attractor continuously displaceable along said slide surface in magnetically retentive relationship with said third magnetic attractor, such that said fourth magnetic attractor is positionable at any of said second plurality of datum locations as a visual pointer to said second date indicia at a selected one of said second plurality of datum locations, and said anchor point is located on said generally linear slide surface.

17. A perpetual calendar comprising:

a structure including a base, at least one arcuate portion above said base and a corresponding anchor point above said base and below said arcuate portion for each said arcuate portion, a plurality of datum locations spaced along each said arcuate portion, a fixed magnetic attractor stationary on said structure at each of said datum locations, date indicia at each of said datum locations, a movable magnetic attractor for each anchor point anchored by a non-rigid line to said corresponding anchor point, each said line having a length sufficient to bring said movable magnetic attractor within magnetic attraction range of any of said corresponding fixed magnetic attractors along said corresponding arcuate portion so that each said line is held taut by said magnetic attraction thereby to serve with said corresponding movable magnetic attractor as a visual pointer to a selected one of said date indicia on said corresponding arcuate portion, each movable magnetic attractor remaining stationary above said corresponding anchor point and below said any of said corresponding fixed magnetic attractor relative to said corresponding arcuate portion in magnetic attraction with any one of said corresponding fixed magnetic attractors until displaced into magnetic attraction with another of said corresponding fixed magnetic attractors.

18. A perpetual calendar comprising:

a structure having a bottom and an arc portion, first date indicia at spaced locations along said arc portion, a fixed magnetic attractor stationary on said structure at each of said spaced locations, an anchor point located above said bottom and below said arc portion, an indicator connected by a string to said anchor point, and a selected first movable magnetic attractor in said indicator, said string having a length selected to be held taut above said anchor point by magnetic attraction between a selected said fixed magnetic attractor and said first movable magnetic attractor and thereby provide a static first visual indicator pointing to said first date indicia at a selected one of said spaced locations along said arc portion.

19. The perpetual calendar of claim 18 further comprising a generally linear slide surface supported on said structure, second date indicia spaced along said slide surface, a fixed magnetic attractor along said slide surface, and a second movable magnetic attractor displaceable on said slide surface in magnetically retentive relationship with said fixed magnetic attractor along said slide surface for providing a second visual pointer to selected said second date indicia along said slide surface.

20. The perpetual calendar of claim 19 wherein said first date indicia along said arc portion differ qualitatively from said second date indicia along said slide surface.

21. The perpetual calendar of claim 19 wherein said first date indicia and said second date indicia are selected from the group consisting of day-of-week, day-of-month and month.

22. The perpetual calendar of claim 19 wherein said slide surface intersects said arc portion.

23. The perpetual calendar of claim 18 wherein said structure comprises a ring and said arc portion is an arc of said ring.

* * * * *